United States Patent [19]

Holdt et al.

[11] 4,222,131

[45] Sep. 16, 1980

[54] HOOK TYPE FOWLER FOR HOSPITAL STRETCHERS

[75] Inventors: Donald H. Holdt; James S. Sims, Jr., both of Cambridge, Md.

[73] Assignee: Chemed Corporation, Cincinnati, Ohio

[21] Appl. No.: 942,528

[22] Filed: Sep. 15, 1978

[51] Int. Cl.[2] ..... A47C 19/00

[52] U.S. Cl. ..... 5/79; 5/86; 5/77

[58] Field of Search ..... 5/63, 66, 68, 70, 71, 5/74, 79, 92, 433

[56] References Cited

U.S. PATENT DOCUMENTS

| | | | |
|---|---|---|---|
| 3,277,501 | 10/1966 | Frisz et al. | 5/66 |
| 3,676,881 | 7/1972 | Duprey | 5/66 |
| 3,800,338 | 4/1974 | Smith | 5/433 |

*Primary Examiner*—Casmir A. Nunberg

*Attorney, Agent, or Firm*—William Kovensky

[57] ABSTRACT

A quick release for the back rest (Fowler) of hospital stretchers. The conventional threaded crank actuator carries a mating threaded block and a sliding block, the sliding block being connected to the head rest. Manually operated hook means permits disengagement between the blocks to free the back rest. Inadvertent disengagement preventing safety means, and re-engagement means are also provided.

17 Claims, 8 Drawing Figures

HOOK TYPE FOWLER FOR HOSPITAL STRETCHERS

This invention relates to hospital stretchers and more in particular it pertains to an improved mechanism for controlling the head rest of such stretchers. The invention was developed using hospital stretchers of the type shown in prior U.S. Pat. Nos. 3,026,542 and 3,050,745 by Paul C. Tabbert. Frisz U.S. Pat. No. 3,277,501 shows another type of Fowler mechanism for hospital beds or stretchers. Reference can be had to those prior patents for more details about other portions of the stretchers not shown or described herein.

Hospital stretchers have a back rest to permit the patient to sit up while holding the patient's head and upper torso in an ajusted inclined position with respect to the remainder of the stretcher top. This is known as the "Fowler" position and the mechanism has also come to be called the "Fowler" mechanism. Accordingly, the word "Fowler" , as used throughout the specification and claims hereof, shall be understood to mean such a portion of such a stretcher.

A typical prior art Fowler is shown in FIG. 1 of Tabbert's U.S. Pat. No. 3,026,542, particularly the mechanism carrying reference Nos. 17 through 23. This is simply a portion of the top which is hinged at 18 and which is operated by a crank 23 which operates a threaded block 20 and link 19 to move the Fowler to an infinite number of adjusted positions.

The problem with this Tabbert Fowler and the prior art Fowlers generally is that a quick lowering of the patient to a full reclining position is difficult to achieve because the crank has to be turned many times. These cranks typically have a relatively fine pitch thread to permit gentle motion of the patient, infinite adjustment and to prevent "sliding" of thread slippage.

Thus, it is a primary object of the invention to provide a quick release for Fowlers to permit quick lowering, to do so safely, to permit quick return to the previous adjusted position, while retaining the prior art crank actuation and its advantages as an alternate modus operandi.

Another object of the invention is to provide means to prevent inadvertant disengagement of the quick release mechanism. If the quick release mechanism were inadvertantly disengaged while the patient was on the stretcher, the patient's head and upper torso would be rapidly slammed down onto the top of the stretcher thus possibly injuring the patient and certainly startling him or her.

As still another object, the invention provides a trigger for the quick release mechanism located in an ideal place for the attendant's hand; at the upper end of the Fowler. The attendant can simultaneously raise the Fowler to disengage the interlock or safety part of the invention, release the quick release, thereupon himself assuming the weight of the patient and then gently and safely lower the patient much quicker than could be accomplished by use of the crank.

To accomplish these ends, the invention provides a modified connection to the conventional crank comprising a threaded block and a sliding block. The sliding block carries a hook mechanism which connects to pin means on the threaded block. The hook mechanism pivots on the sliding block under the control of an aircraft type push-pull cable, the trigger for which is located on the underside of the Fowler. Operation of this trigger, after the safety step of a slight lifting of the Fowler with the patient thereon, frees the sliding block from the threaded block. The Fowler mechanism is connected to the sliding block and the threaded block is connected to the crank mechanism. The trigger cannot be operated before the safety step is performed.

FIG. 1 is a perspective view of a hospital stretcher embodying the invention;

FIGS. 2 and 3 are partial cross-sectional views taken on lines 2—2 and 3—3 respectively of FIG. 1;

Figure 6:
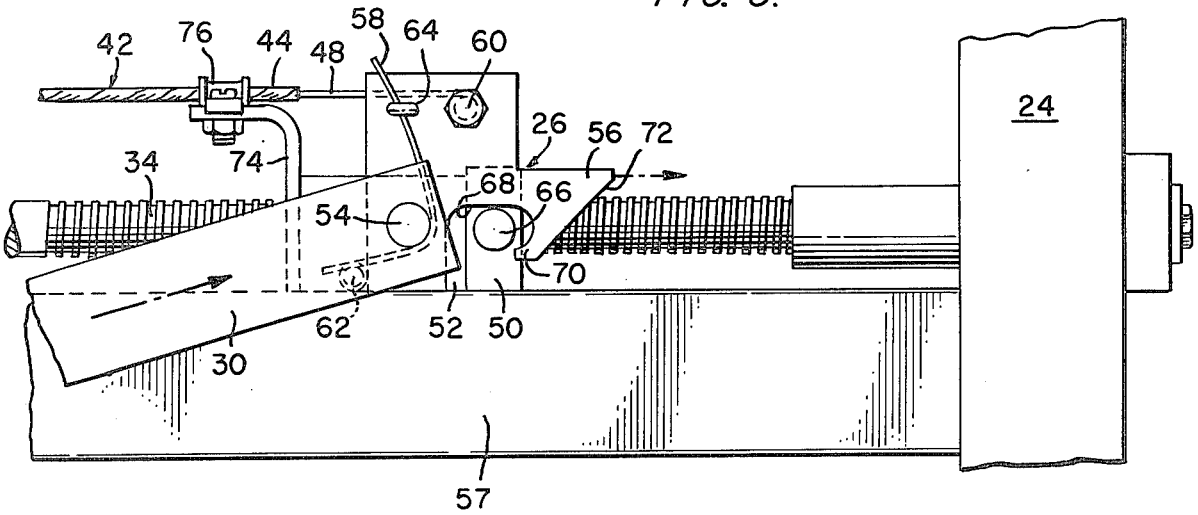
Figure 7:
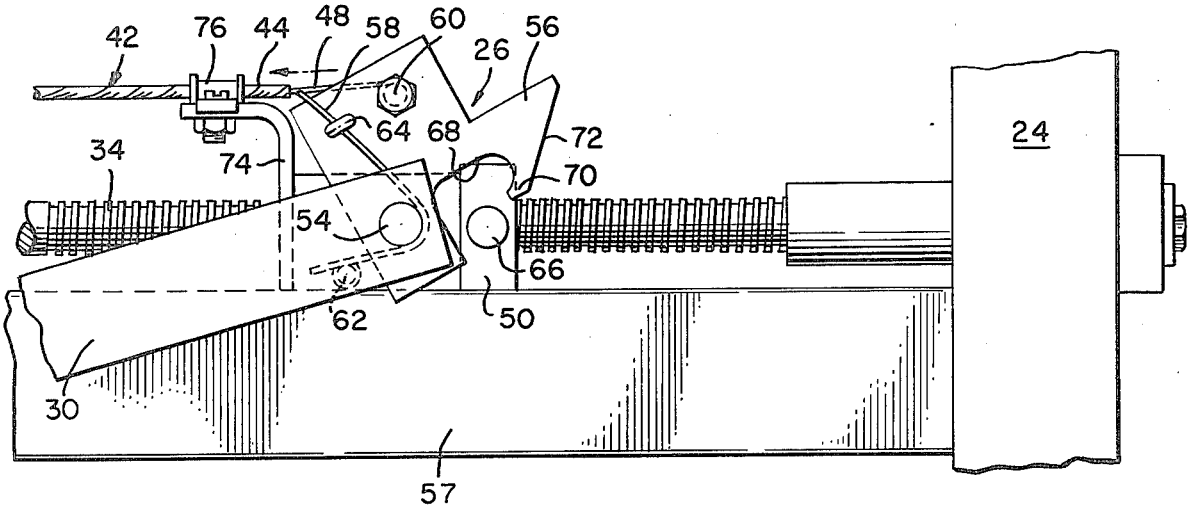
Figure 8:
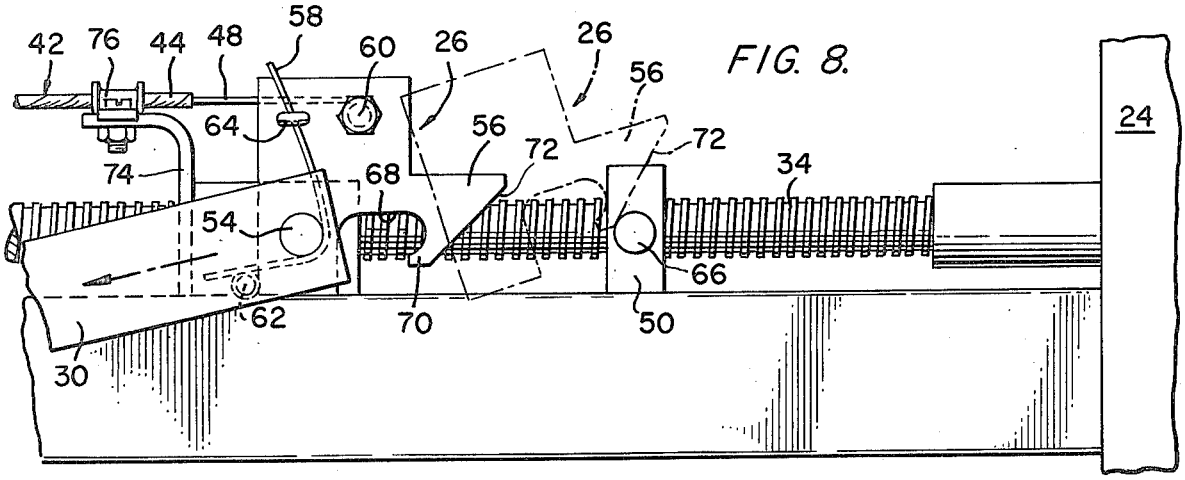

FIGS. 6, 7 and 8 are "action" views illustrating the mode of operation of the invention with a phantom showing in FIG. 8 showing still another position. Referring now in detail to the drawings, there is shown a hospital stretcher 10 with a Fowler 12 embodying the invention. The Fowler 12 is mounted on the stretcher top frame 14. Further details, as to the stretcher per se, can be found in the above-identified patents and are well known to those skilled in the art.

To the extent pertinent to the invention, the Fowler 12 comprises a U shaped frame member 16 cross-connected by a frame member 18 and pivoted to a frame member 20 to the top frame 14. The top frame 14 carries a frame member 22 which is mounted on a post member 24 which is moved vertically up and down by other means.

Figure 2:
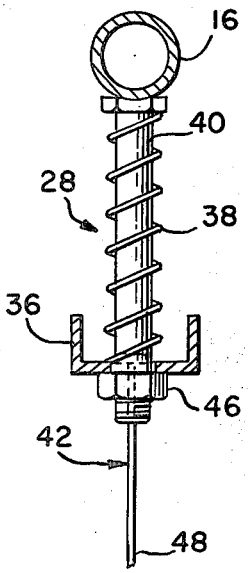
Figure 4:
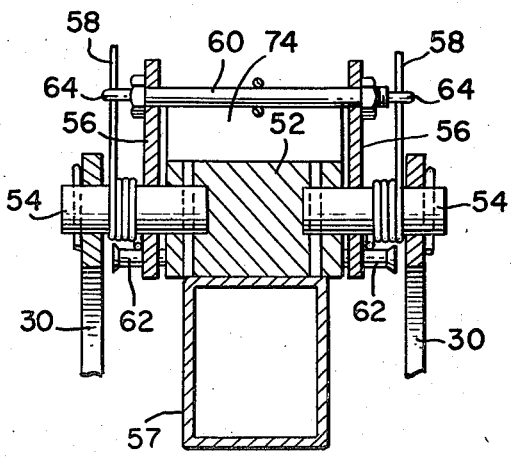
FIG. 4 is a cross-sectional view taken on line 4—4 of FIG. 3.
Figure 3:
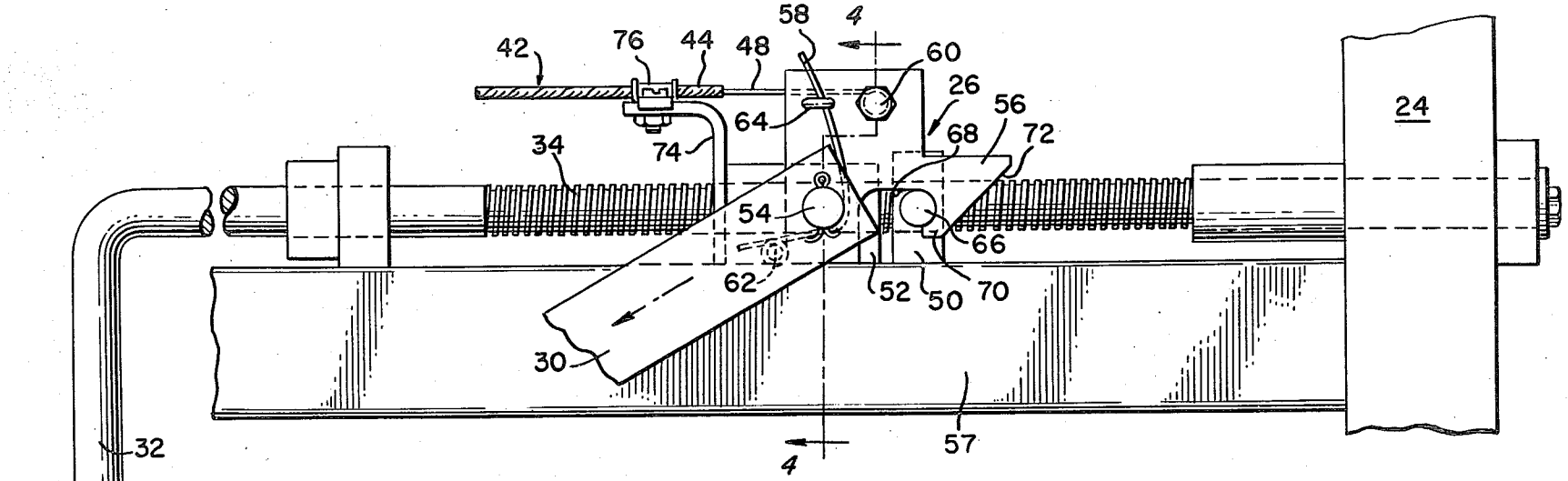
Figure 5:
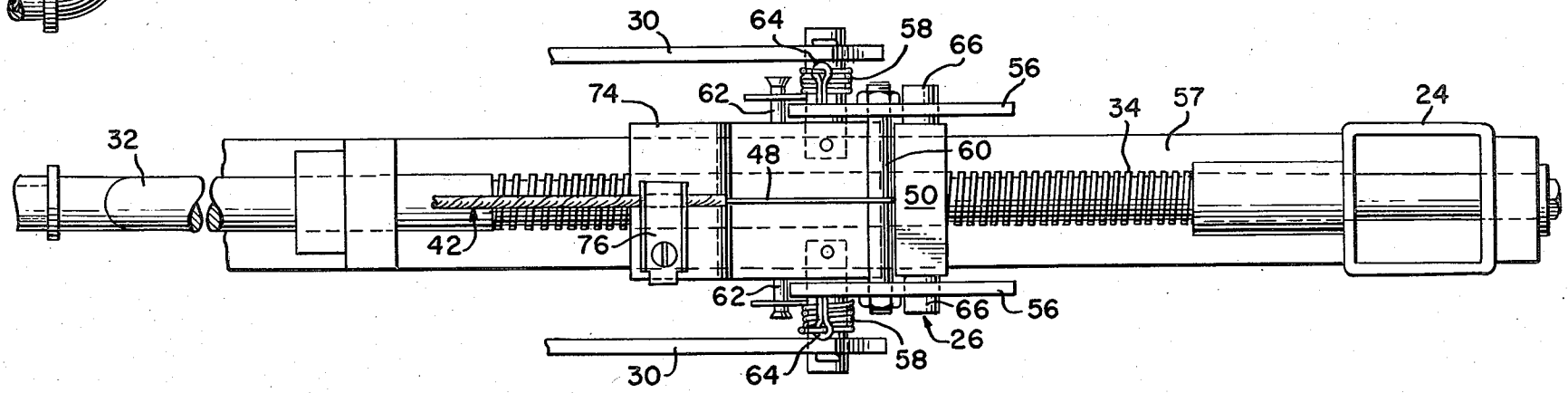
FIG. 5 is a top elevational view taken from FIG. 3.

The invention quick release Fowler mechanism 26 is shown in greater detail in FIGS. 3, 4 and 5. The trigger portion 28 thereof is shown in FIG. 2 in greater detail. A conventional link assembly 30 interconnects the quick release mechanism 26 to the head rest frame member 18 in the conventional manner. A conventional crank 32 having a threaded portion 34 is used to operate the invention release mechanism 26, see below.

Figure 1:
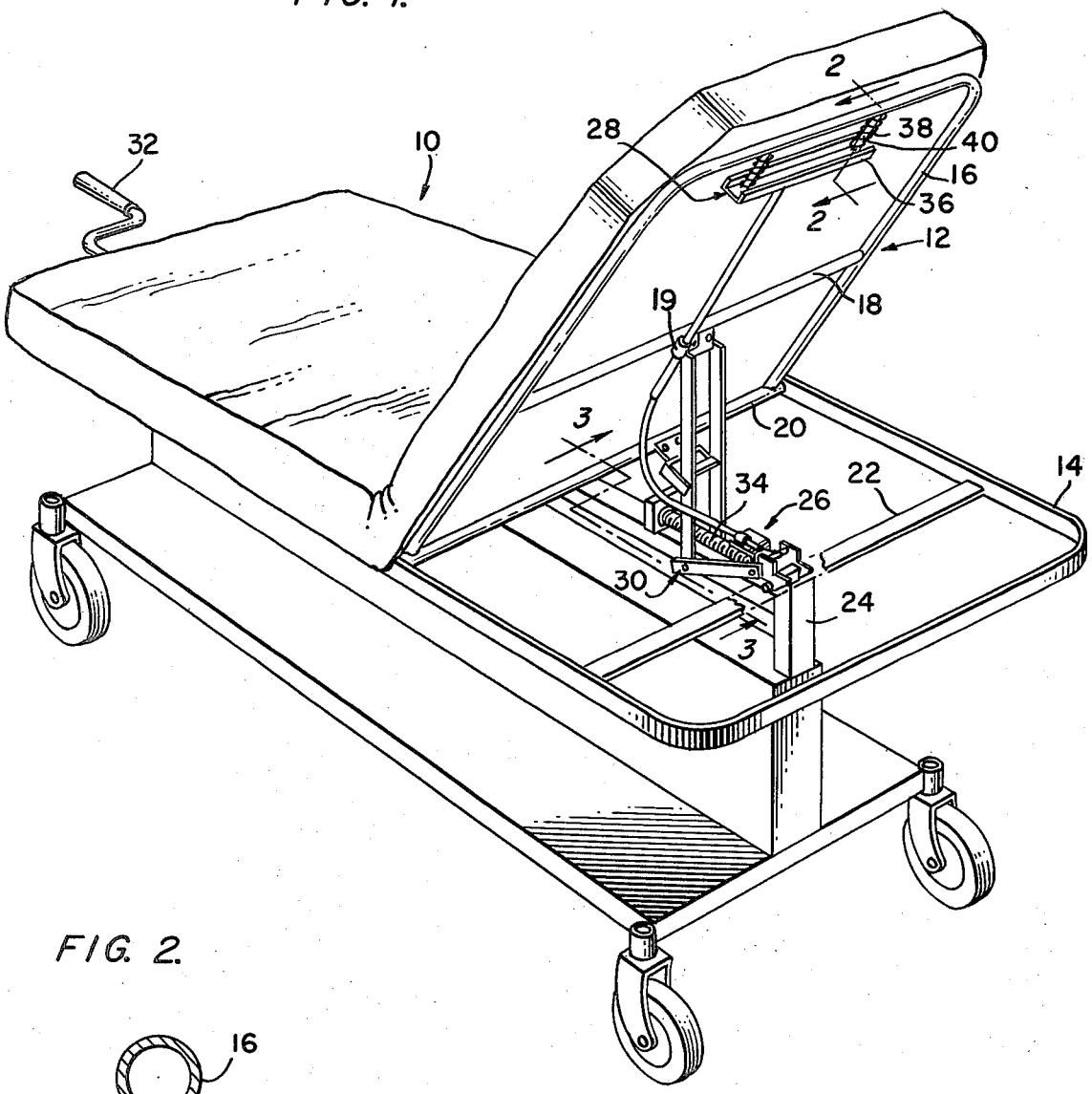

Referring now to FIG. 2, the trigger mechanism comprises a release bar 36 which is biased by a spring 38 to the downward position away from the top frame member 16. Bar 36 rides on a pin assembly 40 mounted inside the spring 38 and secured to the frame bar 16. As shown in FIG. 1, two such spring loaded support bars 38-40 are provided to provide stability to the release bar 36. Intermediate its ends, the release bar 36 connects to a push-pull cable 42. The sheath 44 of this cable is secured to the Fowler member 18 by a clamp 19 (FIG. 1), and the center core 48 is secured by means 46 to the release bar 36, see FIG. 2, and is used to operate the remainder of the invention mechanism, as set forth below.

Referring now to FIGS. 3, 4 and 5, quick release 26 comprises a threaded block 50 and a sliding block 52. The threaded block 50 is more or less in accordance with the state of the art comprising internal threads for cooperation with the threads on the crank 34. The sliding block 52 has a smooth central bore large enough to snugly but easily slidingly fit around portion 34. The Fowler links 30 are connected to the sliding block 52 on the main pivot pin 54 thereof. Both blocks 50 and 52 rest upon a main structural member of the stretcher top 57.

Also mounted on the main pivot pins 54 of the sliding block 50 are a pair of hook plates 56. These plates are pivotally mounted and are spring biased by torsion springs 58, one on each side, trained about the main pivot pins 54. The hook plates are joined together at their upper ends by pin assembly 60. The hook plates are normally biased to the right, clockwise, as shown in FIG. 3, by the ends of the torsion springs, connected one against abutments 62 carried by the sliding block 52 and the other end being held by cotter pins 64 carried by the hook plates 56. As is shown in FIG. 5, the core 48 of the push-pull cable 42 terminates and connects at this cross pin 60.

The threaded block 50 carries a pair of outrigger pins 66. These pins are engaged by an elongated hook portion 68 formed in each of the plates 56. It should be noted that the return leg portions 70 of these hook portions 68 underlie a substantial portion of the outrigger pins 66, which provides the safety interlock of the invention.

The hook plates also include a front tapered nose portion 72 the function of which will be set forth below.

At the opposite end of the sliding block 52 a bracket 74 is provided, to which is mounted a clamp 76 by which the sheath 44 of the operating end of the push-pull cable 42 is secured to the sliding block.

Operation

FIG. 3 shows the normal position of the parts in all positions of the threaded block 50 on the threaded portion 34, whether or not the threaded block 50 is actually in motion under the control of the crank 32 and whether or not there is a patient on the stretcher. The weight of the stretcher, with or without the additional weight of the patient, provides a normal pull in the direction of the arrow shown on the link 30 in FIG. 3. The pins 66 on the threaded block are within the return portion 70 of the hook 68 on the hook plates 56. In this configuration, with the weight pulling in the direction of the arrow, the threaded block will move under the control of the crank 32. If the threaded block is moved to the right, it will pull the sliding block along. If the threaded block is moved to the left, then the weight on the sliding block normally urging it in that direction will cause it to smoothly follow the relatively slow motion of the threaded block. As mentioned above, the threads 34 are of a relatively fine pitch and this member moves relatively slowly under the manual operation of the crank, even when the crank is vigorously operated.

Referring now to FIGS. 6, 7 and 8, the other parts of the operation are shown. Let it be assumed that it is necessary to quickly lower a patient from a full or substantially upright position to the fully reclined position, as for a medical emergency or sleeping. The invention could save a great deal of hospital staff time and effort if used in normal day to day operation. Substantially more time and much more attendant fatigue is involved in lowering the patient using the crank 32, as is conventional in the art, than with the use of the invention. Of course, the crank option is still available, as for example, if the patient should want to have a partial reclined position merely adjusted slightly. If the hospital prefers, the invention could be used for emergencies only.

In any case, assuming it is desired to lower the patient quickly to the fully reclined position, referring to FIGS. 1, 6 and 7, the operator would grasp the stretcher with, let us say, his left hand standing on the left side of the patient, to steady the stretcher. The attendant would hold the top of the Fowler with his right hand and with one or more of the four fingers of his right hand grasp the release bar 36. To disengage the hook plates 56 from the pins 66, it is necessary for the attendant to slightly lift the Fowler and take up with his own strength the full weight of the Fowler with the patient thereon. This slight lift is indicated by the arrow in FIG. 6 and it causes the return hook part 70 of the hook portion 68 to disengage from the pins 66 on the threaded block. Once this is accomplished, the operator can squeeze the release bar 36 thus pivoting the assemblage of the hook plates 56 connected by the cross bar 60, as indicated in FIG. 7, against the biasing force of the torsion springs 58. Thereafter, once the hooks 68 are clear of the pins 66, as shown in FIG. 8, the release bar can be released, the torsion spring will return the hook assembly 66 to the horizontal position, as shown in FIG. 8 and the attendant can gently lower the Fowler with the patient thereon and can do so in much less time and with much less fatigue than would be required using the crank.

The phantom view in FIG. 8 illustrates another advantage of the invention, the rapid return to the engaged FIG. 3 position. By simply raising the Fowler as described above by grasping its outer end, the tapered nose portion 72 will slide up on the pins 66 and will re-engage therewith after the weight is released by the attendant. Thus, a previously selected position is automatically re-attained. For example, if the patient finds a particular angle of incline that suits him, he can return to it repeatedly between taking naps or sleeping by using the invention.

While the invention has been described in detail above, it is to be understood that this detailed description is by way of example only and the protection granted is to be limited only within the spirit of the invention and the scope of the following claims.

We claim:

1. In a hospital stretcher of the like having a back rest actuated by a single threaded crank, the improvement comprising quick release means to permit said back rest to be disengaged from the single threaded crank to be moved rapidly to the fully reclined position.

2. The combination of claim 1, and safety means to prevent inadvertent disengagement of said quick release means.

3. The combination of claim 2, said quick release means comprising; a first portion engageable with said crank actuator for conventional crank actuation of said back rest, a second portion connected to said rest, and hook means interconnecting said portions.

4. The combination of claim 2, said safety means comprising hook means having a return portion whereby an attendant must move the back rest slightly assuming the weight of the patient and of the back rest himself to disengage said return portion of said hook means prior to disengagement of said quick release means.

5. The combination of claim 1, said quick release means comprising manually operable trigger means located at the outermost underside surface of said back rest, whereby an attendant with one hand can simultaneously grasp the outer end of the back rest while operating the quick release trigger means to thereby safely lower the back rest with the patient thereon after disengagement of said quick release means.

6. The combination of claim 1, said crank actuator including a threaded rod, said quick release means comprising a mating threaded block on said threaded rod for motion axially thereof and a sliding block on said threaded rod freely moveable axially thereon, hook means interconnecting said threaded block and said sliding block, and means connecting said back rest to said sliding block, whereby disengagement of said hook means between said sliding block and said threaded block permits motion of said back rest free of said crank means.

7. The combination of claim 6, said hook means comprising a pair of hook plates pivotally mounted on said sliding block, pin means on said threaded block for engagement with said hook plates, spring means normally biasing said hook plates into engaged relationship with said pin means on said threaded block, and trigger means for pivoting said hook plates out of engagement with said pin means.

8. The combination of claim 7, and said trigger means being located at the underside of the outermost portion of said back rest.

9. The combination of claim 7, and safety means to prevent inadvertant disengagement of said hook means on said pin means, said safety means comprising a return portion of said hook means, whereby an attendant must move the back rest slightly assuming the weight of the patient and of the back rest himself to disengage said return portion of said hook means prior to disengagement of said quick release means.

10. The combination of claim 7, said hook plates comprising an inclined tapered nose portion adopted to slidingly engage said pin means, whereby said back rest can be moved from the fully reclined position to an inclined position previously determined by the position of said threaded block on said threaded rod by sliding engagement of said inclined nose portion of said threaded block pin means to re-engage said sliding block to said threaded block.

11. Th combination of claim 6, and trigger means for manual operation of said hook means, cable means interconnecting said trigger means and said hook means, means to mount said trigger means at the underside of the outermost end of said back rest, whereby an attendant with one hand can simultaneously grasp the outer end of the back rest while operating the quick release trigger means to thereby safely lower the back rest with the patient thereon after disengagement of said quick release means.

12. The combination of claim 11, said trigger means comprising a member mounted on a pair of posts fixed to the frame of said back rest and compression springs on said posts between said trigger member and said frame to normally bias said trigger member to the engaged condition of said hook means between said sliding block and said threaded block.

13. The combination of claim 6, said hook means including nose means for sliding engagement with means on said threaded block, whereby said back rest can be moved from the fully reclined position to an inclined position previously determined by the position of said threaded block on said threaded rod by sliding engagement of said nose means on said threaded block to re-engage said sliding block.

14. A method of quick disengagement of a hospital stretcher Fowler mechanism to permit the stretcher back rest to be quickly returned to a fully reclined position, comprising the steps of connecting the Fowler mechanism to a sliding block, permitting said sliding block motion free of the normal crank mechanism, providing hook means interconnecting said sliding block with a threaded block, engaging said threaded block with a mating threaded member in said crank mechanism, and operating said hook means to permit motion of said back rest free of said crank mechanism when said blocks are dis-engaged or under the control of said crank mechanism when said blocks are engaged by said hook means.

15. The method of claim 14, and the step of locating trigger means for said hook means at the underside of the outermost end of said back rest, whereby an attendant with one hand can simultaneously grasp the outer end of the back rest while operating the quick release trigger means to thereby safely lower the back rest with the patient thereon after disengagement of said quick release means.

16. The method of claim 14, and the step of providing safety means to prevent inadvertant disengagement of said quick release means by requiring the attendant to lift the back rest with the patient thereon prior to permitting said hook means to disconnect said sliding and threaded blocks.

17. The method of claim 14, and permitting said back rest to re-assume an inclined position previously determined by said threaded block on its mating crank mechanism threaded member by sliding nose means on said hook means over cooperating means to re-engage said sliding and threaded blocks at said previously determined position.

* * * * *

UNITED STATES PATENT AND TRADEMARK OFFICE

CERTIFICATE OF CORRECTION

PATENT NO. 4,222,131

DATED September 16, 1980

INVENTOR(S) Donald Harvey Holdt and James S. Sims, Jr.

It is certified that error appears in the above-identified patent and that said Letters Patent are hereby corrected as shown below:

Column 4, claim 3, line 4 after "said" add --back--.

Column 5, claim 11, line 1, change "Th" to --The--.

Signed and Sealed this

*Thirtieth* Day of *December 1980*

[SEAL]

*Attest:*

SIDNEY A. DIAMOND

*Attesting Officer*

*Commissioner of Patents and Trademarks*